US010576536B2

(12) United States Patent
Argoud et al.

(10) Patent No.: US 10,576,536 B2
(45) Date of Patent: Mar. 3, 2020

(54) METHOD FOR POSITIONING A CORE IN A MOULD

(71) Applicant: SAFRAN AIRCRAFT ENGINES, Paris (FR)

(72) Inventors: Vincent Michel Argoud, Moissy-Cramayel (FR); Thibault Dalon, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/324,283

(22) PCT Filed: Aug. 3, 2017

(86) PCT No.: PCT/FR2017/052185
§ 371 (c)(1),
(2) Date: Feb. 8, 2019

(87) PCT Pub. No.: WO2018/029422
PCT Pub. Date: Feb. 15, 2018

(65) Prior Publication Data

US 2019/0168292 A1 Jun. 6, 2019
US 2020/0038941 A2 Feb. 6, 2020

(30) Foreign Application Priority Data

Aug. 9, 2016 (FR) ..... 16 57663

(51) Int. Cl.
*B22C 21/14* (2006.01)
*B22C 9/10* (2006.01)

(52) U.S. Cl.
CPC ..... *B22C 21/14* (2013.01); *B22C 9/108* (2013.01)

(58) Field of Classification Search
CPC ..... B22C 21/14; B22C 9/108
See application file for complete search history.

(56) References Cited

FOREIGN PATENT DOCUMENTS

DE 10 2007 050316 A1 4/2009
EP 1637253 3/2006
(Continued)

OTHER PUBLICATIONS

International Patent Application No. PCT/FR2017/052185, English translation of International Search Report and Written Opinion dated Nov. 27, 2017, 6 pgs.
(Continued)

*Primary Examiner* — Kevin P Kerns
*Assistant Examiner* — Steven S Ha
(74) *Attorney, Agent, or Firm* — Lathrop GPM LLP

(57) ABSTRACT

The invention relates to a method for determining the position of the cores in an injection mould, comprising the steps essentially consisting of:

selecting a core $R_{rep}$ in a population of cores with the least difference from the mean of the measured differences between k cores and the theoretical three-dimensional spatial model, positioning this core $R_{rep}$ in space relative to at least one of the functional faces of a theoretical three-dimensional spatial model of the core, and repositioning core support points so that they can support the core $R_{rep}$ in the position corresponding to its repositioning in space performed in the previous step.

14 Claims, 1 Drawing Sheet

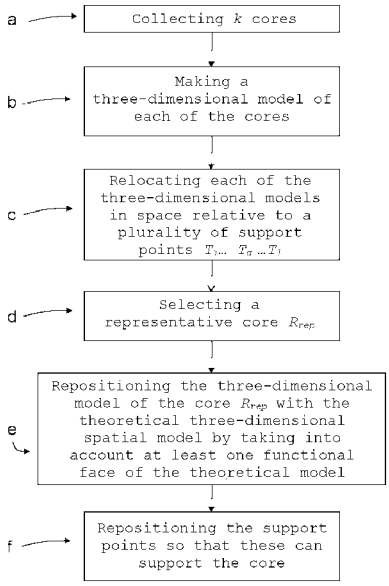

(56) References Cited

FOREIGN PATENT DOCUMENTS

| | | | |
|---|---|---|---|
| FR | 2874186 | | 2/2006 |
| FR | 2875425 | | 3/2006 |
| JP | 2007 333462 | A | 12/2007 |
| WO | WO 2013/135236 | A1 | 9/2013 |

OTHER PUBLICATIONS

International Patent Application No. PCT/FR2017/052185, International Search Report and Written Opinion dated Nov. 27, 2017, 8 pgs. (relevance in citations and English translation of ISR).

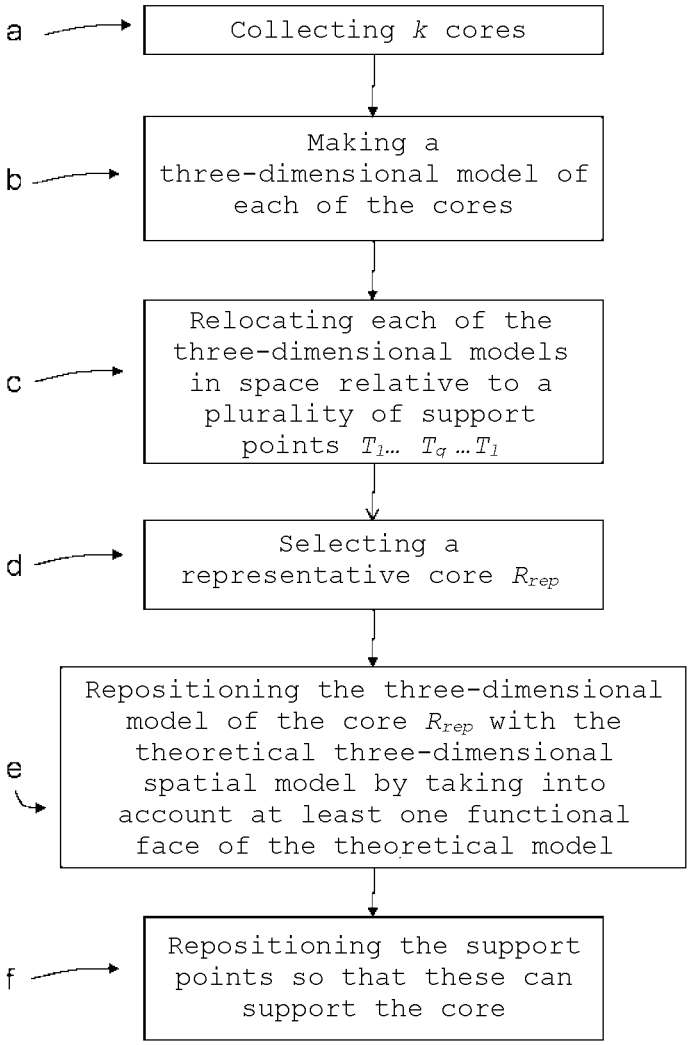
a
Collecting $k$ cores
b
Making a three-dimensional model of each of the cores
c
Relocating each of the three-dimensional models in space relative to a plurality of support points $T_1 \ldots T_q \ldots T_l$
d
Selecting a representative core $R_{rep}$
e
Repositioning the three-dimensional model of the core $R_{rep}$ with the theoretical three-dimensional spatial model by taking into account at least one functional face of the theoretical model
f
Repositioning the support points so that these can support the core

METHOD FOR POSITIONING A CORE IN A MOULD

CROSS-REFERENCE TO RELATED APPLICATIONS

This application is a 35 U.S.C. § 371 filing of International Application No. PCT/FR2017/052185 filed Aug. 3, 2017, which claims the benefit of priority to French Patent Application No. 1657663 filed Aug. 9, 2016, each of which is incorporated herein by reference in its entirety.

The present invention relates to a method for determining the position of a core in an injection mould, in particular a wax injection mould. This method is intended for the manufacture of parts for turbo machines, such as turbine blades.

Conventionally, the lost-wax casting technique first consists in making a model made of wax, or any other material, that can be easily removed later, of the part to be produced; this model includes an internal part forming a ceramic core that represents the cavities that may be desired inside the blading. The wax model is then dipped several times into a casting slip made of a suspension of ceramic particles to make a shell mould by so-called stucco and drying operations.

Wax is then removed from the shell mould, which is an operation by which wax or the material constituting the original model is removed from the shell. After this elimination, a ceramic mould, the cavity of which reproduces all the shapes of the blade and which still contains the ceramic core intended to generate the internal cavities of the blade is obtained. The mould then undergoes a high-temperature heat treatment or "curing" that gives it the necessary mechanical properties.

The shell mould is then ready for the production of the metal part by casting. After checking the internal and external integrity of the shell mould, the next step consists in pouring a molten metal, which fills the voids between the inner wall of the shell mould and the core, and then solidifying same. In the field of lost-wax casting, there are currently several solidification techniques, and therefore several casting techniques, depending on the nature of the alloy and the expected properties of the part resulting from the casting. These may be columnar structure directed solidification (DS), monocrystalline structure directed solidification (SX) or equiaxic solidification (EX).

After casting the alloy, the shell is broken by a stripping operation. In another step, the ceramic core that has remained enclosed in the resulting blade is chemically removed. The metal blade obtained is then subjected to finishing operations to obtain the finished part.

Exemplary embodiments of a turbine blade using the lost-wax casting technology are given in the Applicant's patent applications FR2875425 and FR2874186.

To form the wax model of the blade, a tool, or wax injection mould is used, in which the core is placed and then the liquid wax is injected through a channel provided for this purpose.

This core must be placed extremely precisely in the injection mould because any discrepancy in its positioning will result in non-conformities in the thickness of the blade walls. Since the blade metal is exposed to very high temperatures, these defects would result in significantly reduced blade life. It is therefore necessary to guarantee with great precision the position of the core in the mould. For this purpose, the moulds currently in use include means for statically supporting the core, with such means possibly including rods, the ends of which form support points to support the core in the mould.

While this type of core positioning is effective, it can nevertheless raise a number of difficulties. Indeed, the cores are made in a mould, the footprint of which corresponds to that of the core. However, even a minor manufacturing defect in the core manufacturing mould, an insufficiently precise estimate of the shrinkage and repeatability coefficients of the curing step following the casting operation, may lead to differences in wall thickness on the final part, which, although not leading to non-compliance, are not desirable. An obvious solution would obviously be to manufacture a new core injection mould that would comply with the manufacturing tolerances for the core. However, this solution is not desirable since the step of making a core manufacturing mould is very expensive, both from the financial point of view and from the point of view of the time required to make it.

The purpose of the invention is in particular to provide a simple, effective and economical solution to the problems of the prior art described above.

To this end, it proposes a method for determining the position of the cores in an injection mould, including the steps of:

a) Collecting k cores noted $R_1 \ldots R_i \ldots R_k$ in a population of cores all based on the same theoretical three-dimensional core model,
b) making a three-dimensional model of each of the cores,
c) relocating each of the three-dimensional models in space relative to a plurality of support points $T_1 \ldots T_q \ldots T_l$ of the core in the mould to obtain a relocated three-dimensional spatial model of each core V1,
d) selecting the core noted $R_{rep}$ the three-dimensional spatial model V1 of which has the least difference with the theoretical three-dimensional spatial model,
e) perform a repositioning of the three-dimensional model of the core $R_{rep}$ with the theoretical three-dimensional spatial model by taking into account at least one functional face of the theoretical model of the core in order to obtain an updated three-dimensional spatial model V2 of the core $R_{rep}$,
f) repositioning the support points $T_q$ so that it can support the core $R_{rep}$ in the position corresponding to the relocated three-dimensional spatial model V2 of the core $R_{rep}$.

According to the invention, a defect in the geometry of the cores is compensated by a repositioning of a representative core relative to the functional faces of the theoretical model. All cores are then positioned in an injection mould in the same way as the representative core is positioned in a mould. The method is therefore particularly interesting when the geometry defect (or defects) of the cores corresponds to a deviation of one dimension from a nominal value. The collection of k cores is carried out randomly.

The term "functional face" of the core refers to a face of the core intended to form, before assembling the part, a face with the final geometry of the part. Such a functional face is an outer face of the core that enables the shaping of the inner or outer faces of the metal part and has an impact on the aerodynamics and thermal properties of the part in operation. In the case of a turbine blade, a functional face can refer to an outer face of the core forming an inner face of a core wall, such as a front side or back side wall for example. The internal cavity of the blade can be a cavity for cooling the blade.

The term "three-dimensional model" in reference to a core should be interpreted as a set of digital data allowing a three-dimensional digital reconstruction of the core, for example using a geometric mesh.

The term "spatial" refers to a three-dimensional model positioned in space.

The term "relocated" refers to a three-dimensional spatial model that has been positioned or repositioned in space.

According to another characteristic, each three-dimensional model can be obtained from a three-dimensional survey of the outer surface of the core, for example from a contactless measurement that can be performed by optical triangulation. In such a configuration, a central projector illuminates a room with a network of fringes that are observed by two CCD cameras. A polygonal mesh of the outer surface of each of the cores is deduced from this.

In one particular embodiment of the invention, step d) may include the following steps:

selecting n points noted $P_1 \ldots P_j \ldots P_n$ on at least one of the functional faces of the theoretical model of the core, selecting the core $R_{rep}$ the n points of the relocated three-dimensional spatial model V1 of which have the least difference with the same n points of the spatial theoretical model.

In this alternative embodiment, the determination of the representative core is thus carried out by measuring the differences on a functional side after relocation on the support points. It is indeed interesting to measure the differences relative to at least one functional face since it is a face that has a direct impact on a corresponding face of the final part.

Also, step d) may include the following steps for each core $R_L$:

i. determining the difference $E_{i,j}^1$ between each point $P_j$ of the theoretical model and the model V1, ii. calculating the average $$M_j(E_{i,j}^1) = \frac{1}{k}\sum_{i=1}^{k} E_{i,j}^1$$

iii. calculating $\Delta_{i,j}^1 = E_{i,j}^1 - M_j(E_{i,j}^1)$ iv. calculating, for each core $R_i$, $S_i^1 = \Sigma_{j=1}^n \Delta_{i,j}^{1\ 2}$ v. considering the core $R_i$ which the lowest value is assigned $S_i^1$ to as the representative core $R_{rep}$ of the core population.

Preferably, the method includes a checking step, between steps e) and f), consisting in verifying that the relocated spatial model V2 of the core $R_{rep}$ is better positioned than the relocated spatial model V1 of the core $R_{rep}$.

If the relocation V2 is worse than the relocation V1, then the relocation V2 should be repeated on a smaller number of functional faces than the number of functional faces previously used.

The checking step includes the following steps:

i. determining the difference $E_{rep,j}^2$ between each point $P_j$ of the theoretical three-dimensional spatial model and the relocated three-dimensional spatial model V2 of the core $R_{rep}$ relative to the functional faces, ii. calculating $S_{rep}^2 = \Sigma_{j=1}^n E_{i,j}^{2\ 2}$, iii. comparing $S_{rep}^2$ with $S_{rep}^1$ in order to verify that $S_{rep}^2$ is less than $S_{rep}^1$.

The difference $E_{i,j}^1$ and/or the difference $E_{rep,j}^2$ can be determined along the normal to the theoretical three-dimensional spatial model at the point $P_j$.

The repositioning of the support points in step f) can be done as follows, for each of the support points $T_q$:

projecting a point $T_q$ as normal to the theoretical three-dimensional spatial model passing through the contact point of the support point $T_q$ with the theoretical three-dimensional spatial model, on the relocated three-dimensional spatial model V2, in order to obtain a point $T_q$, modifying the support points in the mould so that they are brought to the level of the points $T'_q$.

In a practical embodiment of the invention, k is greater than or equal to five and/or l is greater than or equal to six and/or n is greater than or equal to three. In practice, n is a function of the curvature and tolerance of the functional face considered. The lower the curvature, the smaller n. Thus, the minimum number of n is three, which corresponds to the minimum number of points required to position a plane isostatically in space.

In the manufacture of a turbomachine part, the injection mould is a wax injection mould. The core can be a turbine blade core for example.

The invention will be better understood and other details, advantages and characteristics of the invention will appear in the following non-exhaustive illustrative description, with reference to FIG. 1 representing the main steps of the method according to the invention.

In a first step a) of the method, k cores noted $R_1 \ldots R_i \ldots R_k$ are selected in a population of cores, all based on the same theoretical three-dimensional core model. The term "population" here refers to a set of cores, the number of which can be determined or undetermined.

In a second step (b) of the method, a three-dimensional measurement of the external surface of each of the cores is obtained from a contactless measurement that can be an optical measurement, for example by optical triangulation as mentioned above. Of course, other methods of measurement could be used without going beyond the scope of the invention. For example, another method may consist in using a more accurate but much slower sensing device or a three-dimensional measuring machine (TDMM). The three-dimensional survey makes it possible to establish a three-dimensional model of each of the cores, i.e. a digital model including a set of coordinates of points on the surface of a core, thus enabling a relative positioning of the points.

In a third step c), the method includes a step of spatially positioning each of the three-dimensional models relative to l support points $T_1 \ldots T_q \ldots T_l$ of the core in the mould in order to obtain a three-dimensional spatial model $V_1$ for each core. This positioning thus consists of a spatial relocation relative to the l support points.

In practice, this relocation can be achieved by minimizing the difference between the theoretical three-dimensional spatial model and the relocated three-dimensional spatial model V1 of each of the cores, at the level of points $T_q$. Minimizing can be done using the least squares method.

The method then consists, in a fourth step, in selecting the core noted $R_{rep}$, the three-dimensional spatial model V1 of which has the smallest deviation from the calculated mean deviations between the actual models and the theoretical three-dimensional spatial model. This step is executed on n points $P_j$ noted $P_1 \ldots P_j \ldots P_n$ belonging to at least one of the functional faces of the theoretical model of the theoretical core. Preferably, the n points are distributed over a maximum number of functional faces. Preferably, the n points are distributed over the selected functional faces and a number of points per face is selected according to the curvature and tolerance applied to the face considered.

This step of selecting the core representative of the k cores is performed by executing the following steps:

i. determining the difference $E_{i,j}^1$ between each point $P_j$ of the theoretical model and the model V1, along the normal to the theoretical model passing through the point $P_j$, ii. calculating the average $$M_j(E_{i,j}^1) = \frac{1}{k}\sum_{i=1}^{k} E_{i,j}^1$$

iii. calculating $\Delta_{i,j}^1 = E_{i,j}^1 - M_j(E_{i,j}^1)$ iv. calculating for each core $R_i$, $S_i^1 = \Sigma_{j=1}^n \Delta_{i,j}^{1\ 2}$ v. considering the core $R_i$ which the lowest value is assigned to $S_i^1$ as the representative core $R_{rep}$ of the core population.

In order to be able to determine the desired new position of the representative core $R_{rep}$ in the mould, a second relocation of the three-dimensional model must then be performed, in a fifth step, by taking into account at least one functional face of the theoretical model of the core in order to obtain a relocated three-dimensional spatial model V2 of the core $R_{rep}$.

Unlike the relocation V1 performed for each of the cores, the relocation of the representative core $R_{rep}$ is performed only on at least one of the functional faces and does not take into account the support points $T_q$. The aim here is to enable a repositioning of the representative core $R_{rep}$ in order to minimize the shape differences between the part obtained from the representative core and a theoretical part from the theoretical core, with the constraint of the support points $T_q$ being eliminated.

Before proceeding to the sixth step, i.e. step f), a preliminary step of checking the relocation of the three-dimensional spatial model of the core (V2) $R_{rep}$ is performed. This checking step includes the following steps:

i. determining the difference $E_{rep,j}^2$ between each point $P_j$ of the theoretical three-dimensional spatial model and the relocated three-dimensional spatial model V2 of the core $R_{rep}$ relative to the functional faces, with such difference being measured along the normal passing through the point P of the theoretical three-dimensional spatial model, ii. calculating $S_{rep}^2 = \Sigma_{j=1}^n E_{i,j}^{2\ 2}$, iii. comparing $S_{rep}^2$ with $S_{rep}^1$ in order to verify that $S_{rep}^2$ is less than $S_{rep}^1$.

When $S_{rep}^2$ is greater than $S_{rep}^1$, several situations arise. If the relocation of the three-dimensional model of the core $R_{rep}$ has been performed on only one functional face, then it is necessary to establish that the three-dimensional spatial model V1 of the core $R_{rep}$ is preferable since it shows that the relocation of the cores on the functional faces does not make it possible to obtain a better positioning of the core. If the relocation of the three-dimensional model is performed on a plurality of functional faces, i.e. F functional faces, with $F \geq 2$, then the relocation of step e) is performed on F−1 functional faces and then it is determined whether the new relocation V2 of the three-dimensional spatial model $R_{rep}$ is better than the relocation V1 of the core $R_{rep}$ by comparing $S_{rep}^2$ with $S_{rep}^1$.

In a complementary approach, it would be possible to classify functional faces into at least two groups, with a first group of primary functional faces and a second group of secondary functional faces. The main functional faces are faces for which the manufacturing tolerances are lower than for the secondary functional faces so that the relocation performed in step e) can be performed preferentially on the main functional faces. Thus, if the relocation of step e) has to be performed again, it is preferable to remove the constraint of the relocation relative to a secondary functional face. Eventually, it will be necessary to check that the differences in the secondary functional faces between the theoretical three-dimensional spatial model and the new three-dimensional model V2 do not exceed the permissible manufacturing tolerances.

The sixth step f) consists in repositioning the support points $T_q$ so that the core $R_{rep}$ can be supported in the position corresponding to the relocated three-dimensional spatial model V2 of the core $R_{rep}$.

This repositioning is obtained by performing the following steps:

projecting a point $T_q$ as normal to the theoretical three-dimensional spatial model passing through the contact point of the support point $T_q$ with the theoretical three-dimensional spatial model, on the relocated three-dimensional spatial model V2, in order to obtain a point $T'_q$, modifying the support points in the mould so that they are brought to the level of the points $T'_q$.

In practice, to carry out the second sub-step above, the distance between each pair of points $T_q$ and $T'_q$ is determined, which gives us l distances. These distances correspond to the positioning corrections to be applied to the ends of the core support rods.

The invention claimed is:

1. A method for determining a position of cores in an injection mould, comprising the steps of:

a) Collecting k cores noted $R_1 \ldots R_i \ldots R_k$ in a population of cores all produced from a same theoretical three-dimensional core model, b) making a three-dimensional model of each of the cores, c) relocating each of the three-dimensional models in space relative to l support points $T_1 \ldots T_q \ldots T_l$ of the core in the mould to obtain a relocated three-dimensional spatial model of each core V1, d) selecting a core noted $R_{rep}$ the three-dimensional spatial model V1 of which has the least difference with a theoretical three-dimensional spatial model, e) relocating the three-dimensional model of the core $R_{rep}$ with the theoretical three-dimensional spatial model by taking into account at least one functional face of the theoretical model of the core in order to obtain a relocated three-dimensional spatial model V2 of the core $R_{rep}$, f) repositioning the support points $T_q$ so that it can support the core $R_{rep}$ in the spatial position corresponding to the relocated three-dimensional spatial model V2 of the core $R_{rep}$.

2. A method according to claim 1, wherein each three-dimensional model is obtained from a three-dimensional survey of the outer surface of the core.

3. A method according to claim 2, wherein the three-dimensional survey of the outer surface of the core is obtained from a contactless measurement.

4. A method according to claim 2, wherein step d) comprises the following steps:

selecting n points noted $P_1 \ldots P_j \ldots P_n$ on the at least one functional face of the theoretical model of the core, selecting the core $R_{rep}$ that has the n points of the relocated three-dimensional spatial model V1 having the least difference with the same points n of the spatial theoretical model.

5. A method according to claim 1, wherein step d) comprises the following steps:

selecting n points noted $P_1 \ldots P_j \ldots P_n$ on the at least one functional face of the theoretical model of the core, selecting the core $R_{rep}$ that has the n points of the relocated three-dimensional spatial model V1 having the least difference with the same points n of the spatial theoretical model.

6. A method according to claim 5, wherein step d) comprises the following steps for each core $R_i$:

i. determining the difference $E_{i,j}^1$ between each point $P_j$ of the theoretical model and the model V1, ii. calculating the average $$M_j(E_{i,j}^1) = \frac{1}{k}\sum_{i=1}^{k} E_{i,j}^1$$

iii. calculating $\Delta_{i,j}^1 = E_{i,j}^1 - M_j(E_{i,j}^1)$ iv. calculating for each core $R_i$, $S_i^1 = \Sigma_{j=1}^n \Delta_{i,j}^{1\ 2}$ v. considering the core $R_i$ which the lowest value is assigned $S_i^1$ to as the representative core $R_{rep}$ of the population of cores.

7. A method according to claim 6, comprising a checking step, between steps e) and f), consisting in verifying that the relocated spatial model V2 of the core $R_{rep}$ is better positioned than the relocated spatial model V1 of the core $R_{rep}$.

8. A method according to claim 7, wherein the checking step includes the following steps:

i. determining the difference $E_{rep,j}^2$ between each point $P_j$ of the theoretical three-dimensional spatial model and the relocated three-dimensional spatial model V2 of the core $R_{rep}$, ii. calculating $S_{rep}^2 = \Sigma_{j=1}^n E_{i,j}^{2\ 2}$, iii. comparing $S_{rep}^2$ with $S_{rep}^1$ in order to verify that $S_{rep}^2$ is less than $S_{rep}^1$.

9. A method according to claim 8, wherein the difference $E_{i,j}^1$ and/or the difference $E_{rep,j}^2$ are determined according to the normal to the theoretical three-dimensional spatial model at the point $P_j$.

10. A method according to claim 6, wherein the difference $E_{i,j}^1$ and/or the difference $E_{rep,j}^2$ are determined according to the normal to the theoretical three-dimensional spatial model at the point $P_j$.

11. A method according to claim 5, wherein n is greater than or equal to three.

12. A method according to claim 1, wherein step f) comprises the following steps for each of the support points $T_q$:

projecting a point $T_q$ as normal to the theoretical three-dimensional spatial model passing through a contact point of the support point $T_q$ with the theoretical three-dimensional spatial model, on the relocated three-dimensional spatial model V2, in order to obtain a point $T'_q$, modifying the support points in the mould so that they are brought to the level of the points $T'_q$.

13. A method according to claim 1, wherein k is greater than or equal to five and/or l is greater than or equal to six.

14. A method according to claim 1, wherein the injection mould is a wax injection mould.

* * * * *